US009381522B2

(12) United States Patent
Vielhuber

(10) Patent No.: US 9,381,522 B2
(45) Date of Patent: Jul. 5, 2016

(54) SOLID-BOWL SCREW-TYPE CENTRIFUGE HAVING A CONNECTING FLANGE

(71) Applicant: Flottweg SE, Vilsbiburg (DE)

(72) Inventor: Benno Vielhuber, Vilsbiburg (DE)

(73) Assignee: Flottweg SE, Vilsbiburg (DE)

( * ) Notice: Subject to any disclaimer, the term of this patent is extended or adjusted under 35 U.S.C. 154(b) by 0 days.

(21) Appl. No.: 14/673,915

(22) Filed: Mar. 31, 2015

(65) Prior Publication Data

US 2015/0283559 A1 Oct. 8, 2015

(30) Foreign Application Priority Data

Apr. 4, 2014 (DE) ..... 10 2014 104 820

(51) Int. Cl.
*B04B 1/20* (2006.01)
*B04B 9/12* (2006.01)

(52) U.S. Cl.
CPC ... *B04B 1/20* (2013.01); *B04B 9/12* (2013.01); *B04B 2001/2041* (2013.01); *B04B 2001/2083* (2013.01)

(58) Field of Classification Search
CPC ..... B04B 1/20; B04B 11/02; B04B 1/2016; B04B 2001/2033; B04B 2001/2041; B04B 2001/205; B04B 9/12
USPC ..... 494/52–54, 56, 84; 210/377, 380.1, 210/380.3
See application file for complete search history.

(56) References Cited

U.S. PATENT DOCUMENTS 2,679,974 A * 6/1954 Gooch ..... B04B 1/20 494/15
2,703,676 A * 3/1955 Gooch ..... B04B 1/20 475/330
3,282,497 A * 11/1966 Schmiedel ..... B04B 1/20 210/374
3,424,375 A * 1/1969 Maurer ..... B04B 1/20 494/11
5,387,175 A * 2/1995 Madsen ..... B04B 9/12 494/53
2015/0283559 A1* 10/2015 Vielhuber ..... B04B 9/12 494/53

FOREIGN PATENT DOCUMENTS

DE 1002689 B * 2/1957 ..... B04B 1/20
WO 2009/059922 5/2009

* cited by examiner

*Primary Examiner* — Charles Cooley
(74) *Attorney, Agent, or Firm* — Gerald E. Hespos; Michael J. Porco; Matthew T. Hespos

(57) ABSTRACT

A solid-bowl screw-type centrifuge for clarifying substance uses a centrifuge drum that can hold the substance, and has a pond radius. A centrifuge screw is situated in the centrifuge drum. The centrifuge screw is supported on one of its axial end regions by a connecting flange that protrudes axially inward on a drum cover of the centrifuge drum and has a flange outside radius at a transition to the drum cover. The flange outside radius of the connecting flange is larger than the pond radius.

10 Claims, 4 Drawing Sheets

SOLID-BOWL SCREW-TYPE CENTRIFUGE HAVING A CONNECTING FLANGE

BACKGROUND

1. Field of the Invention

The invention relates to a solid-bowl screw-type centrifuge for clarifying good or substance(s), having a centrifuge drum, in which the substance(s) may be contained and then has a pond radius, and having a centrifuge screw situated in the centrifuge drum and supported on one of its axial end regions by means of a connecting flange, which is arranged on a drum cover of the centrifuge drum, protruding axially inward, and has a flange outside radius at a transition to the drum cover.

2. Description of the Related Art

Solid-bowl screw-type centrifuges, which are also known as decanters, have a centrifuge drum which is usually arranged horizontally and contains a centrifuge screw. The centrifuge screw rotates in relation to the centrifuge drum for discharging a dry phase that has been separated and is therefore mounted to rotate in the drum. Decanters in a so-called "long version" are known, having a diameter/length ratio of approximately 1 to 4, and are especially advantageous in separation technology. However, with such thin decanters, the flexural rigidity of the centrifuge screw, which is then also comparatively thin, suffers. In certain applications, for example, in drainage of sewage sludge, there is also an attempt to increase the depth of the pond of the substance to be clarified and/or to design the pond radius to be small accordingly. Then, however, the centrifuge screw with its screw hub must be designed to be thin accordingly, so that the flexural strength of the centrifuge screw also declines but the oscillation susceptibility of the centrifuge screw increases.

SUMMARY OF THE INVENTION

The invention is based on the object of creating a solid-bowl screw-type centrifuge, i.e., a decanter whose centrifuge screw may have a comparatively high flexural strength.

This object is achieved according to the invention with a solid-bowl screw-type centrifuge for clarifying substance, having a centrifuge drum in which the substance may be contained and then having a pond radius, and having a centrifuge screw which is situated in the centrifuge drum and is supported on one of its axial end regions by means of a connecting flange which is arranged so that it protrudes axially toward the inside on a drum cover of the centrifuge drum and has a flange outside radius at a transition to the drum cover, such that the flange outside radius of the connecting flange is designed to be larger than the pond radius.

With the design of the connecting flange on a drum cover according to the invention, it is possible that its flange outside radius and/or flange diameter is designed to be larger than with traditional solid-bowl screw-type centrifuges. According to the invention, the flange outside radius is larger than the pond radius. The connecting flange according to the invention is thus immersed in the substance to be clarified. Such a design is therefore surprising in particular because the connecting flange is fundamentally also surrounded by the screw hub on the outside radially and therefore this screw hub is also immersed in the substance to be clarified. Such a design is initially counterproductive with regard to the highest possible quality of the separation result, but it does lead to a greatly increased rigidity of the arrangement of the centrifuge screw inside the centrifuge drum and is therefore the targeted goal according to the invention. With the design according to the invention, the connecting flange is connected to the drum cover farther toward the outside radially and is supported more rigidly accordingly. Therefore the entire connecting flange itself is more rigid and, with it, the centrifuge screw supported on it as well.

The centrifuge drum may be supported by means of two drum bearings that have a drum bearing distance axially, and the connecting flange has a flange length axially of 1/10 to 1/4, in particular 1/8 to 1/5 of the drum bearing distance. With the connecting flange designed in such a targeted manner with respect to its flange length, an optimum is reached with regard to several parameters. Thus, a solid-bowl screw-type centrifuge can be made available, creating a high-quality separation result with a small pond radius and a large pond depth accordingly as a deep pond version. At the same time, the screw hub radius may be kept very small without any loss of rigidity on the part of the centrifuge screw. Ideally the rigidity of the centrifuge screw can even be increased with the approach according to the invention in comparison with known solid-bowl screw-type centrifuges.

To achieve a particularly high-quality separation result using the solid-bowl screw-type centrifuge the invention, the connecting flange may be designed to be permeable radially for the substance. The clarified substance can pass through the connecting flange in particular to outlet openings that are situated farther toward the inside radially than the flange radius. These outlet openings may traditionally be provided with weir devices, in particular weir gates, by means of which the depth of the pond is adjusted.

The connecting flange may be designed with at least one flange rib aligned axially. The connecting flange according to the invention therefore need not be designed to be solid, i.e., as a solid material, but instead may be shaped as a ribbed structure to reduce the inert mass of the centrifuge drum. The at least one flange rib creates an axially oriented reinforcement between the drum cover and the bearing that supports the centrifuge screw. The outside radius of the flange according to the invention is then defined with the outermost point on the flange rib radially on the drum cover.

The connecting flange may taper starting from the drum cover axially into the centrifuge drum, in particular with a conical taper. The taper creates a cross-sectional shape for the connecting flange, which advantageously is adapted to the bending moment characteristic and/or transverse force characteristic on the connecting flange. At the same time, the connecting flange is kept as light as possible with respect to its inert mass. In addition, a shape tapering in the axial direction into the centrifuge drum is advantageous for the design of the screw hub surrounding the connecting flange.

The screw hub may be designed with a screw hub radius adjacent to the drum cover, with this radius being larger than the radius of the pond. Furthermore, the centrifuge screw may be designed with a screw hub that is radially permeable for the substance in the region of the connecting flange. Furthermore, the screw hub may be designed with at least one axially aligned hub rib in the region of the connecting flange. Finally, the screw hub may taper, in particular tapering conically, into the centrifuge drum, advantageously starting from the drum cover axially in the region of the connecting flange.

Finally, with the solid-bowl screw-type centrifuge according to the invention, the centrifuge screw also may be supported by a screw bearing on the connecting flange that is situated on the connecting flange on the inside radially. The screw bearing which supports the screw hub on the connecting flange normally is arranged on the outside radially around the connecting flange, which is usually circular in cross section there. The connecting flange would thus be on the inside with the screw bearing on the outside and then the screw hub entirely on the outside. However, with the refinement according to the invention, the screw hub is situated on the inside radially, followed by the screw bearing on the outside, and the latter is then surrounded by the connecting flange on the outside. With this structural design, it is possible to design the connecting flange to be more rigid than in the past, which has an advantageous effect on the supporting effect thereof and thus has an advantageous effect on the overall vibrational behavior of the centrifuge screw.

One exemplary embodiment of the approach according to the invention is explained in greater detail below on the basis of the accompanying schematic drawings.

DETAILED DESCRIPTION OF THE PREFERRED EMBODIMENT

Figure 1:
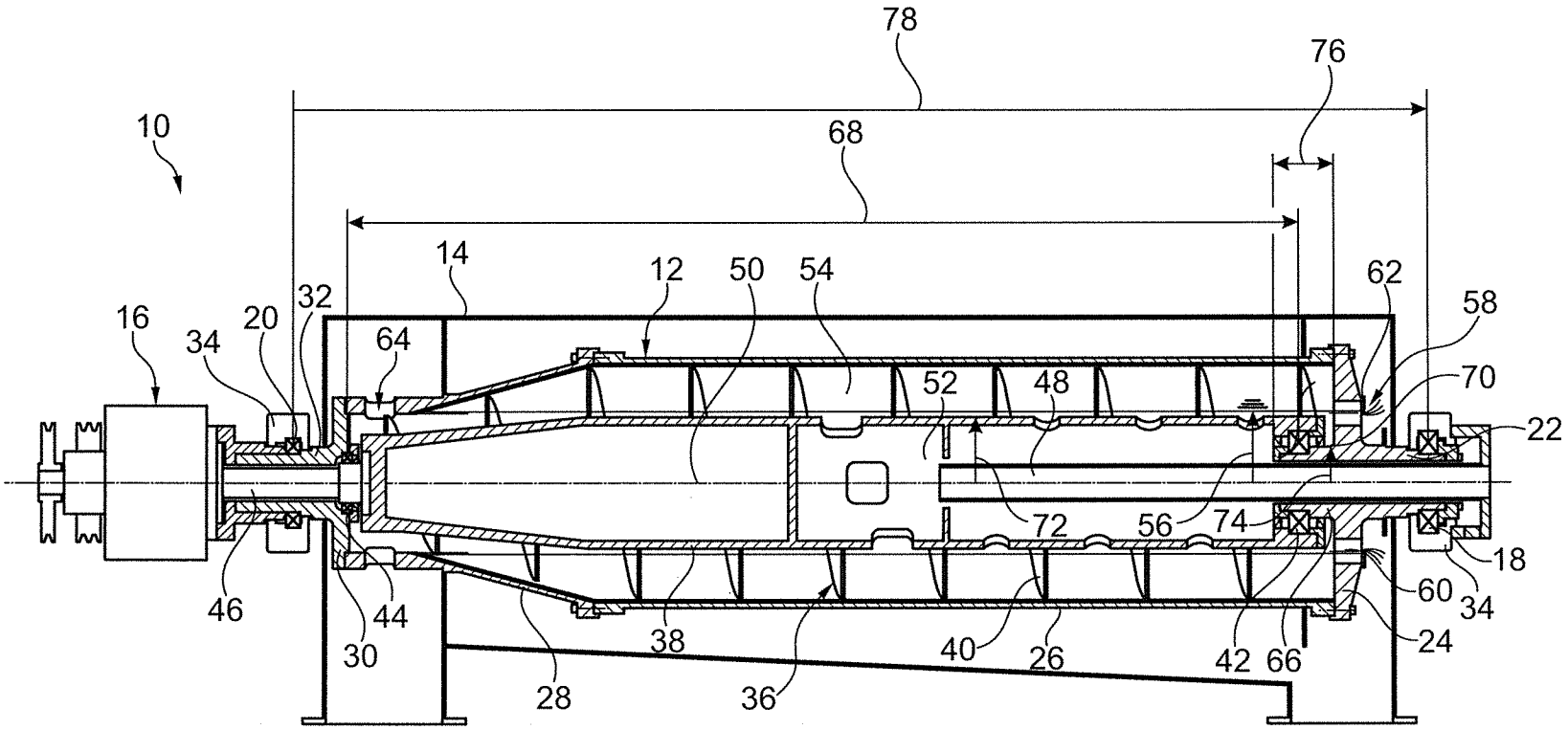
Prior Art Fig. 1
FIG. 1 shows a longitudinal section through a solid-bowl screw-type centrifuge according to the prior art.

FIG. 1 shows a solid-bowl screw-type centrifuge 10 with its rotatable centrifuge drum 12. The centrifuge drum 12 is surrounded by a stationary drum housing 14 and can be driven by means of a centrifuge drive 16 on one of its end faces. The centrifuge drum 12 therefore is supported with a first drum bearing 18 and a second drum bearing 20. The first drum bearing 18 is supported on a first drum flange 22, which is in turn mounted in a stationary position on a first drum cover 24. A cylindrical drum jacket section 26, which develops into a conical drum jacket section 28, is connected to the first drum cover 24. The conical drum jacket section 28 then ends at a second drum cover 30, on which a second drum flange 32 is ultimately mounted in a stationary position for supporting the second drum bearing 20. In this way, the centrifuge drum 12 is mounted essentially in a horizontal position on a centrifuge frame 34, which is illustrated only partially here.

The centrifuge drum 12 contains a centrifuge screw 36, that is formed with a screw hub 38 on the inside radially and a screw flight 40 surrounding the latter. The screw hub 38 is supported rotatably within the centrifuge drum 12 with a first screw bearing 42 and a second screw bearing 44. The centrifuge screw 36 can be driven by the centrifuge drive 16 from the outside by means of a screw shaft 46.

Furthermore, an inlet pipe 48 leads from the outside into the centrifuge drum 12, through the first drum flange 22 and the first drum cover 24 into an inlet chamber 52. The inlet tube 48 thus extends along a central centrifuge axis 50 and serves to supply the substance 54, which is sewage sludge in the present case, into the interior, i.e., the interior space of the centrifuge drum 12, so that the substance 54 then is separated into various heavy phases and can be clarified in this way. The substance 54 then adheres to the inside of the cylindrical drum jacket section 26 and the conical drum jacket section 28 due to the resulting centrifugal force in the rotating centrifuge drum 12, thus resulting in a pond radius 56. The pond radius 56 is defined and/or determined in particular by a first outlet 58 for liquid phase, which is designed in the form of plurality outlet openings 60 on the first drum cover 24. The outlet openings 60 are distributed around the centrifuge axis 50, so that they are spaced uniformly on the drum cover 24 and are partially closed on the outside by means of one weir gate 62 each. The substance 54 in a liquid phase then flows out over the weir gates 62. Their radial position thus defines the pond radius 56.

Moreover, a second outlet 64 for solid phase is located in the radially inner region of the conical drum section 28 on the side of the centrifuge drum opposite the first drum cover 24. Solid-phase substance 54 is moved radially inward by means of the screw flight 40 along the conical drum section 28 and then is discharged out of the centrifuge drum 12 through the second outlet 64 due to the centrifugal force.

A connecting flange 66 protruding axially inward is situated on the inside, concentrically with the first drum cover 24. The connecting flange 66 supports and/or carries the first screw bearing 42 on its end region, which faces the interior of the centrifuge drum 12, and in this way also defines a screw bearing distance 68 from the second screw bearing 44. The connecting flange 66 has a flange outside radius 74 at its transition 70 to the drum cover 24. The connecting flange 66 extends in the axial direction from the transition 70 into the centrifuge drum 12 with a flange length 76. The flange outside radius 74 is smaller than the pond radius 56, and the screw hub radius 72 is also smaller than the pond radius 56. Therefore, neither the screw hub 38 nor the connecting flange 66 protrudes into the substance 54 to be centrifuged. According to FIG. 1, the flange length 76 with such a traditional solid-bowl screw-type centrifuge 12 amounts to approximately 1/18 of a drum bearing distance 78 between the two drum bearings 18 and 20.

Figure 2:
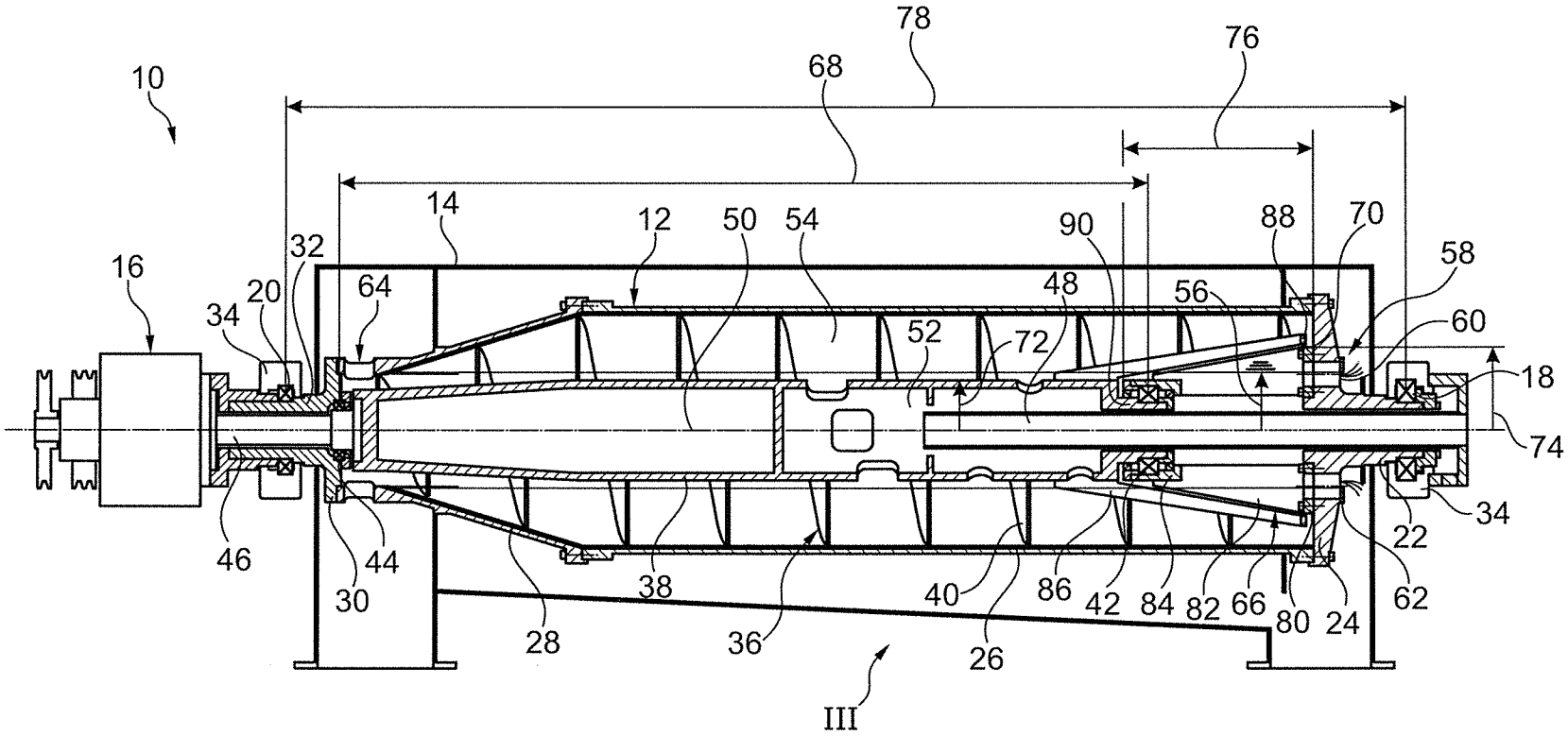
FIG. 2 shows a longitudinal section through an exemplary embodiment of a solid-bowl screw-type centrifuge according to the invention.
Figure 3:
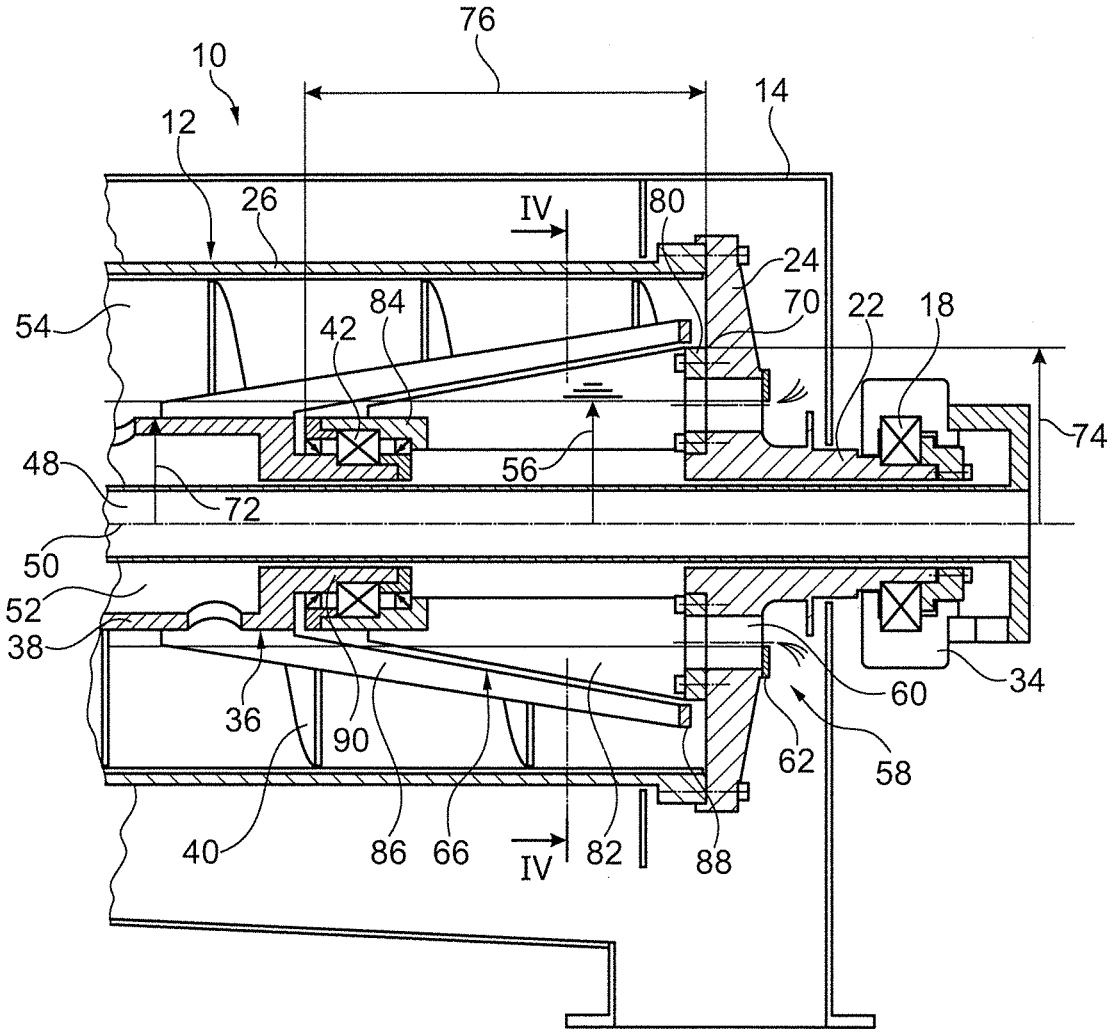
FIG. 3 shows the detail III according to FIG. 2 on an enlarged scale.
Figure 4:
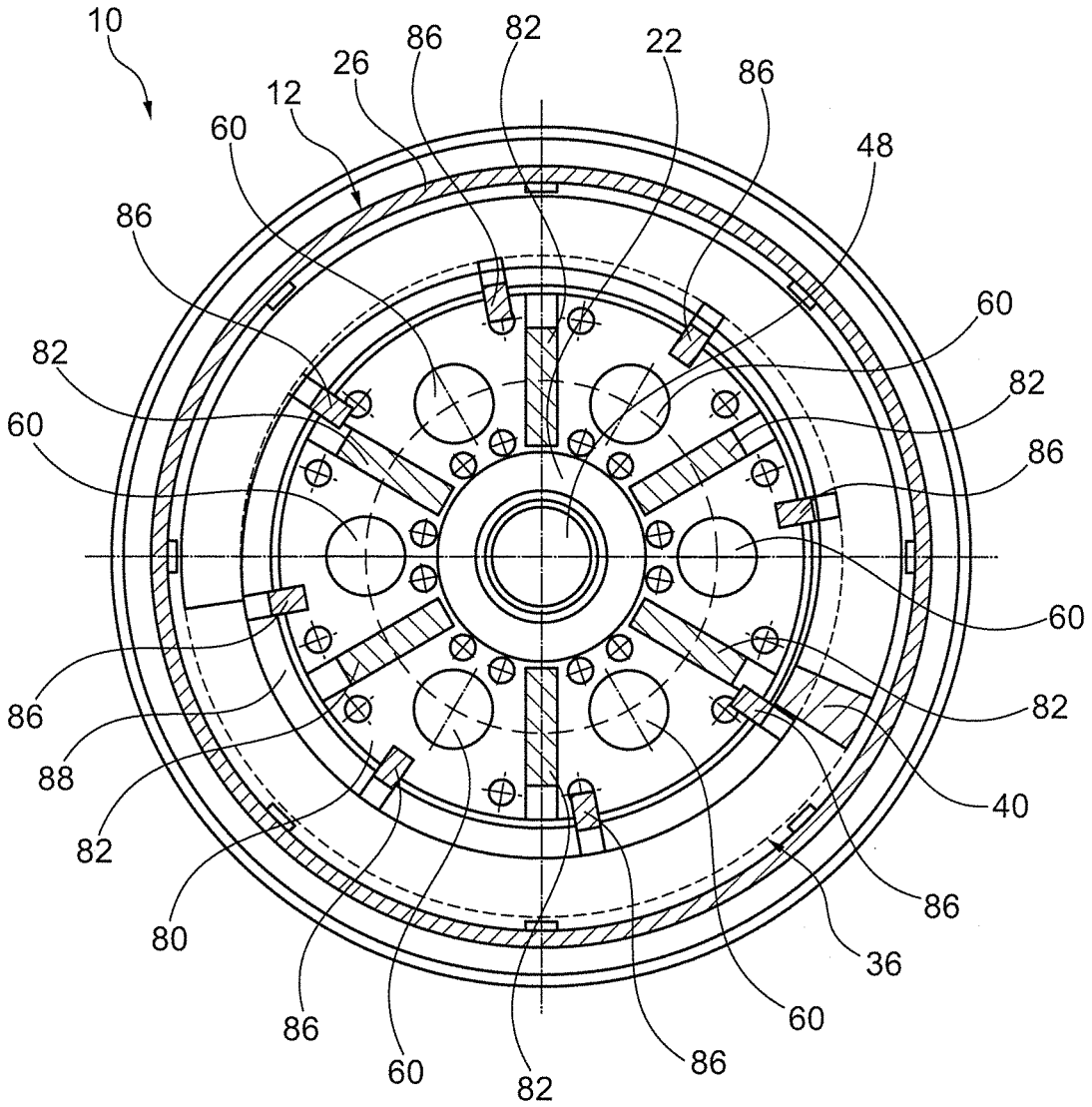
FIG. 4 shows the section IV-IV according to FIG. 3.

FIGS. 2 through 4 illustrate one exemplary embodiment of a solid-bowl screw-type centrifuge 10, in which the connecting flange 66 in particular has a different design than that in the solid-bowl screw-type centrifuge 10 according to FIG. 1. The connecting flange 66 according to FIGS. 2 through 4 has a flange outside radius 74 at the transition 70 that is larger than the respective pond radius 56. This connecting flange 66 thus is immersed in the substance 54 to be centrifuged. The respective outlet openings 60 for liquid phase thus protrude farther inward radially with their weir gates 62 than this connecting flange 66 protrudes outward radially.

Furthermore, this connecting flange 66 protrudes axially farther into the interior of the centrifuge drum 12 than the one according to FIG. 1, namely with a flange length 76 amounting to approximately 1/6 of the drum bearing distance 78. This connecting flange 66 is designed with a flange disk 80 in contact with the drum cover 24 and having a total of preferably between 4 and 8, in the present case 6, flange ribs 82 aligned both axially and radially and mounted in a stationary position. The flange ribs 82 taper conically and end in the interior of the centrifuge drum 12 at a flange bearing ring 84. The flange bearing ring 84 extends around the first screw bearing 42 on the outside radially, so that it is then supported in a stationary position relative to the drum cover 24 and at the same time is particularly rigidly supported. The grid-shaped connecting flange 66 is thus permeable from the outside to the inside radially for liquid phase of the substance 54. This phase can thus emerge through the outlet openings 60, which are situated farther toward the inside radially, although the connecting flange 66 protrudes farther toward the outside radially. Thus, a solid-bowl screw-type centrifuge 10 is created with an especially small pond radius 56 and/or comparatively great pond depth with rigid bearing support of the respective centrifuge screw 36 at the same time.

The respective screw hub 38 of this centrifuge screw 36 preferably is designed with a total of between 6 and 10 hub ribs 86, namely eight in the present case, in the axial region of the connecting flange 66 according to FIGS. 2 through 4, these hub ribs 86 extending axially and at the same time radially obliquely to the centrifuge axis 50. The hub ribs 86 are connected to one another by a screw hub end ring 88 at their ends facing the drum cover 24. The other ends of the hub ribs 86 are mounted in a stationary position on the essentially hollow cylindrical screw hub 38, which is otherwise essentially unchanged, so that the hub ribs 86 form a supporting skeleton for the screw flights 40 that are situated on the outside radially in the axial region of the connecting flange 66, which is immersed in the substance 54. This supporting skeleton then also is immersed in the substance 54 and is permeable for the substance 54, in particular from the outside radially to the inside radially.

A screw hub bearing ring 90 protrudes radially toward the drum cover 24 in the fastening region of the hub ribs 86 on the remaining screw hub 38, the screw hub bearing ring 90 thereby protruding into the screw bearing 42 on the inside radially. The screw hub 38 therefore is supported on the screw bearing 42 on the inside radially, while the screw bearing 42 is supported on the outside radially by the connecting flange 66 in a particularly advantageous manner statically.

In conclusion, it should be pointed out that all features mentioned in the patent application documents and in particular in the dependent claims should also have independent protection individually or in any combination despite the formal reference back to one or more specific claims.

LIST OF REFERENCE NUMERALS

10 Solid-bowl screw-type centrifuge
12 Centrifuge drum
14 Drum housing
16 Centrifuge drive
18 First drum bearing
20 Second drum bearing
22 First drum flange
24 First drum cover
26 Cylindrical drum jacket section
28 Conical drum jacket section
30 Second drum cover
32 Second drum flange
34 Centrifuge frame
36 Centrifuge screw
38 Screw hub
40 Screw flight
42 First screw bearing
44 Second screw bearing
46 Screw shaft
48 Inlet pipe
50 Centrifuge axis
52 Inlet chamber
54 Substance
56 Pond radius
58 First outlet for liquid phase
60 Outlet opening for liquid phase
62 Weir gate for liquid phase
64 Second outlet for solid phase
66 Connecting flange
68 Screw bearing spacing
70 Transition
72 Screw hub radius
74 Outside radius of flange
76 Length of flange
78 Drum bearing spacing
80 Flange disk
82 Flange rib
84 Flange bearing ring
86 Hub rib
88 Screw hub end ring
90 Screw hub bearing ring

What is claimed is:

1. A solid-bowl screw-type centrifuge (10) for clarifying a substance (54), comprising:

a centrifuge drum (12) in which the substance (54) may be contained, the centrifuge drum (12) extending in an axial direction and a drum cover (24) coupled to a first end of the centrifuge drum (12), the drum cover (24) having a first outlet (58) arranged radially outward of an axis (50) of the centrifuge drum (12) to define a pond radius (56) extending between the axis (50) and the first outlet (58); and a centrifuge screw (36) situated in the centrifuge drum (12) and supported on one of its axial end regions by means of a connecting flange (66) that is arranged protruding axially inward on the drum cover (24) of the centrifuge drum (12), the connecting flange (66) has a flange outside radius (74) at a transition (70) to the drum cover (24), the flange outside radius (74) of the connecting flange (66) being larger than the pond radius (56).

2. The solid-bowl screw-type centrifuge of claim 1, wherein the centrifuge drum (12) is supported by two drum bearings (18, 20) that have a drum bearing distance (78) axially, and the connecting flange (66) having a flange length (76) axially of 1/10 to 1/4 of the drum bearing distance (78).

3. The solid-bowl screw-type centrifuge of claim 1, wherein the connecting flange (66) is radially permeable for the substance (54).

4. The solid-bowl screw-type centrifuge of claim 1, wherein the connecting flange (66) has at least one axially oriented flange rib (82).

5. The solid-bowl screw-type centrifuge of claim 1, wherein the connecting flange (66) of the drum cover (24) tapers axially into the centrifuge drum (12).

6. The solid-bowl screw-type centrifuge of claim 1, wherein the centrifuge screw (36) has a screw hub (38), adjacent to the drum cover (24) and having a screw hub radius (72), that is larger than the pond radius (56).

7. The solid-bowl screw-type centrifuge of claim 1, wherein the centrifuge screw (36) has a screw hub (38) that is permeable by the substance (54) radially in a region of the connecting flange (66).

8. The solid-bowl screw-type centrifuge of claim 1, wherein the centrifuge screw (36) has a screw hub (38), with at least one hub rib (86) aligned axially in a region of the connecting flange (66).

9. The solid-bowl screw-type centrifuge of claim 1, wherein the centrifuge screw (36) has a screw hub (38), that tapers axially into the centrifuge drum (12), starting from the drum cover (24) in a region of the connecting flange (66), into the centrifuge drum (12).

10. The solid-bowl screw-type centrifuge of claim 1, wherein the centrifuge screw (36) is supported by a screw bearing (42) on the connecting flange (66) and is situated on the inside radially on the connecting flange (66).

* * * * *